US009904227B2

(12) United States Patent
Kanakubo

(10) Patent No.: US 9,904,227 B2
(45) Date of Patent: Feb. 27, 2018

(54) IMAGE FORMING APPARATUS, CONSUMABLE PRODUCT MANAGEMENT METHOD, AND STORAGE MEDIUM

(71) Applicant: CANON KABUSHIKI KAISHA, Tokyo (JP)

(72) Inventor: Yukio Kanakubo, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/261,505

(22) Filed: Sep. 9, 2016

(65) Prior Publication Data

US 2017/0075277 A1 Mar. 16, 2017

(30) Foreign Application Priority Data

Sep. 15, 2015 (JP) ..... 2015-181586

(51) Int. Cl.

| | |
|---|---|
| ***G03G 21/00*** | (2006.01) |
| ***G03G 15/08*** | (2006.01) |
| ***G03G 15/00*** | (2006.01) |
| ***G03G 21/18*** | (2006.01) |

(52) U.S. Cl.

CPC ..... *G03G 15/556* (2013.01); *G03G 21/1889* (2013.01); *G03G 21/1892* (2013.01); *G03G 15/0863* (2013.01)

(58) Field of Classification Search

CPC ..... G03G 15/556; G03G 15/0863; G03G 21/1889; G03G 21/1892; G03G 21/1875; G03G 21/1878

USPC ..... 399/12, 24, 25, 26, 27, 110, 111

See application file for complete search history.

(56) References Cited

U.S. PATENT DOCUMENTS

| | | | | |
|---|---|---|---|---|
| 2003/0228163 | A1 | 12/2003 | Yokoi et al. | |
| 2006/0216046 | A1 * | 9/2006 | Hatakeyama ..... | G03G 15/0856 399/27 |
| 2007/0071459 | A1 | 3/2007 | Nakazato | |
| 2008/0240745 | A1 | 10/2008 | Hibino | |

FOREIGN PATENT DOCUMENTS

| | | | |
|---|---|---|---|
| JP | 2002207401 | A * | 7/2002 |
| JP | 2008-250087 | A | 10/2008 |

* cited by examiner

*Primary Examiner* — Sophia S Chen
(74) *Attorney, Agent, or Firm* — Canon USA Inc., IP Division

(57) ABSTRACT

There is provided an image forming apparatus that can detect a replacement of toner cartridge and can accurately manage information after the replacement even if serial numbers of the toner cartridges before and after the replacement are identical to each other. Each toner cartridge is provided with a nonvolatile memory that can record cartridge information, such as printed page count value (i.e., total number of printed sheets) and beginning-of-use date and time. The image forming apparatus includes a device built-in memory that can store and update the cartridge information. The image forming apparatus refers to and compares the cartridge information about two cartridges that are likely to be replaced at arbitrary timing and identifies the replacement of the toner cartridge if any discordance is confirmed.

13 Claims, 12 Drawing Sheets

FIG.6

| SERIAL NUMBER | SIZE | BEGINNING-OF-USE DATA AND TIME | PAGE COUNT VALUE | RESIDUAL QUANTITY | LATEST USE DATA AND TIME | PAGE COUNT VALUE | RESIDUAL QUANTITY | TYPE |
|---|---|---|---|---|---|---|---|---|
| 0123456789 | NORMAL | 2015/01/01 10:05 | 000000000 | 100% | 2015/07/04 12:34 | 000028923 | 0% | GENUINE |
| 0987654321 | NORMAL | 2015/08/04 12:51 | 000000000 | 100% | 2015/12/06 15:15 | 000032511 | 1% | REUSED |
| 0246801357 | LARGE CAPACITY | 2016/01/07 9:20 | 000001500 | 70% | 2016/04/21 15:34 | 000003000 | 60% | REUSED★ |
| 0246801357 | LARGE CAPACITY | 2016/05/01 8:12 | 000000000 | 100% | 2016/11/21 15:34 | 000035000 | 0% | REUSED★ |
| 2358132134 | NORMAL | 2016/11/21 21:20 | 000000000 | 100% | 2017/03/22 13:31 | 000012345 | 35% | GENUINE |

FIG.12

| | | LIFE ALARM HISTORY INFORMATION STORED IN MAIN BODY MEMORY | | |
|---|---|---|---|---|
| LIFE ALARM HISTORY INFORMATION RECORDED IN CARTRIDGE | | FULL STATE | LOW STATE | OUT STATE |
| | FULL STATE | SAME | REPLACED | REPLACED |
| | LOW STATE | SAME | SAME | REPLACED |
| | OUT STATE | SAME | SAME | SAME |

IMAGE FORMING APPARATUS, CONSUMABLE PRODUCT MANAGEMENT METHOD, AND STORAGE MEDIUM

BACKGROUND OF THE INVENTION

Field of the Invention

The present invention relates to an image forming apparatus that can manage replacement history of a consumable product, such as a toner cartridge.

Description of the Related Art

A recent image forming apparatus that uses a toner cartridge, which integrates a photosensitive drum, a development device, and toner particles, as a consumable product, is generally known. In general, a manufacturer of the image forming apparatus provides genuine toner cartridges. On the other hand, reused toner cartridges have been showing up in the market and are available from outsiders. The reused toner cartridge can be manufactured by replenishing a used toner cartridge with new toner particles. The reused toner cartridge is different in toner components from the genuine toner cartridge provided by the manufacturer of the image forming apparatus. Therefore, differences may appear in printing results. The reused toner cartridge may cause a failure or malfunction in a printer body.

An image processing apparatus discussed in Japanese Patent Application Laid-Open No. 2008-250087 can record a history of toner cartridge having been used by a user (or a plurality of users) and can display the recorded history for the purpose of maintenance/guarantee of the apparatus. However, to assure the reliability of the above-mentioned use history record, it is necessary to surely detect a true replacement of toner cartridge. In this respect, the conventional image processing apparatus determines whether toner cartridge has been replaced by simply comparing serial numbers recorded in nonvolatile memories (Hereinbelow, referred to as "memory tags") attached to respective toner cartridges and records a detection result as a history.

The contents recorded in the memory tag attached to the toner cartridge include information necessary to maintain printing qualities in addition to the above-mentioned serial number. There is a reused cartridge to which a copied memory tag is attached. In this case, the reused cartridge can hold contents identical to those of a memory tag attached to a brand-new toner cartridge.

If such a reused toner cartridge is actually used, it is difficult to detect a true replacement of toner cartridge based on a comparison of the serial numbers because the copied memory tag of the reused toner cartridge is identical to that of the brand-new toner cartridge.

The above-mentioned problem is not limited to toner cartridges and will occur in any other consumable products respectively equipped with a memory tag (i.e., serial number holding unit).

The present invention is directed to an image forming apparatus that can accurately detect a replacement of consumable products that are identical to each other in serial number and can accurately manage information relating to the replaced consumable product.

SUMMARY OF THE INVENTION

According to an aspect of the present invention, an image forming apparatus that can form an image by using a consumable product that holds individual information including at least one of reference date and time and use record value, wherein the image forming apparatus includes at least one processor and at least one memory coupled to the at least one processor, and the at least one processor and the at least one memory act as a reading unit configured to read the individual information from a memory of the consumable product, a memory configured to store the read individual information, and a control unit configured to perform a first control or a second control, in which the first control includes adding the individual information read from the memory of the consumable product, as new individual information, to the memory of the image forming apparatus based on a comparison between the reference date and time included in the individual information held in the memory of the consumable product and reference date and time included in individual information stored in the memory of the image forming apparatus, and the second control includes adding the individual information read from the memory of the consumable product, as new individual information, to the memory of the image forming apparatus based on a comparison between the use record value included in the individual information held in the memory of the consumable product and use record value included in the individual information stored in the memory of the image forming apparatus.

According to another aspect of the present invention, an image forming apparatus for forming an image that can form an image by using a consumable product that holds individual information including at least one of reference date and time and use record value, includes a reading unit configured to read the individual information from a memory of the consumable product, a device built-in memory that stores the individual information, and a control unit configured to compare the individual information held by the consumable product and the individual information recorded in the device built-in memory and adds the individual information read from the consumable product to the device built-in memory as new individual information, in a case where a difference between the two pieces of the individual information exceeds a predetermined range.

Further features of the present invention will become apparent from the following description of exemplary embodiments with reference to the attached drawings.

BRIEF DESCRIPTION OF THE DRAWINGS

FIG. 6 is a table illustrating a printed example of replacement history of the cartridge information.

FIG. 12 is a table illustrating life alarm history information determination standards according to the fourth exemplary embodiment.

DESCRIPTION OF THE EMBODIMENTS

Hereinbelow, a first exemplary embodiment will be described in detail below with reference to attached drawings.

<Configuration of Image Forming Apparatus>

Figure 1:
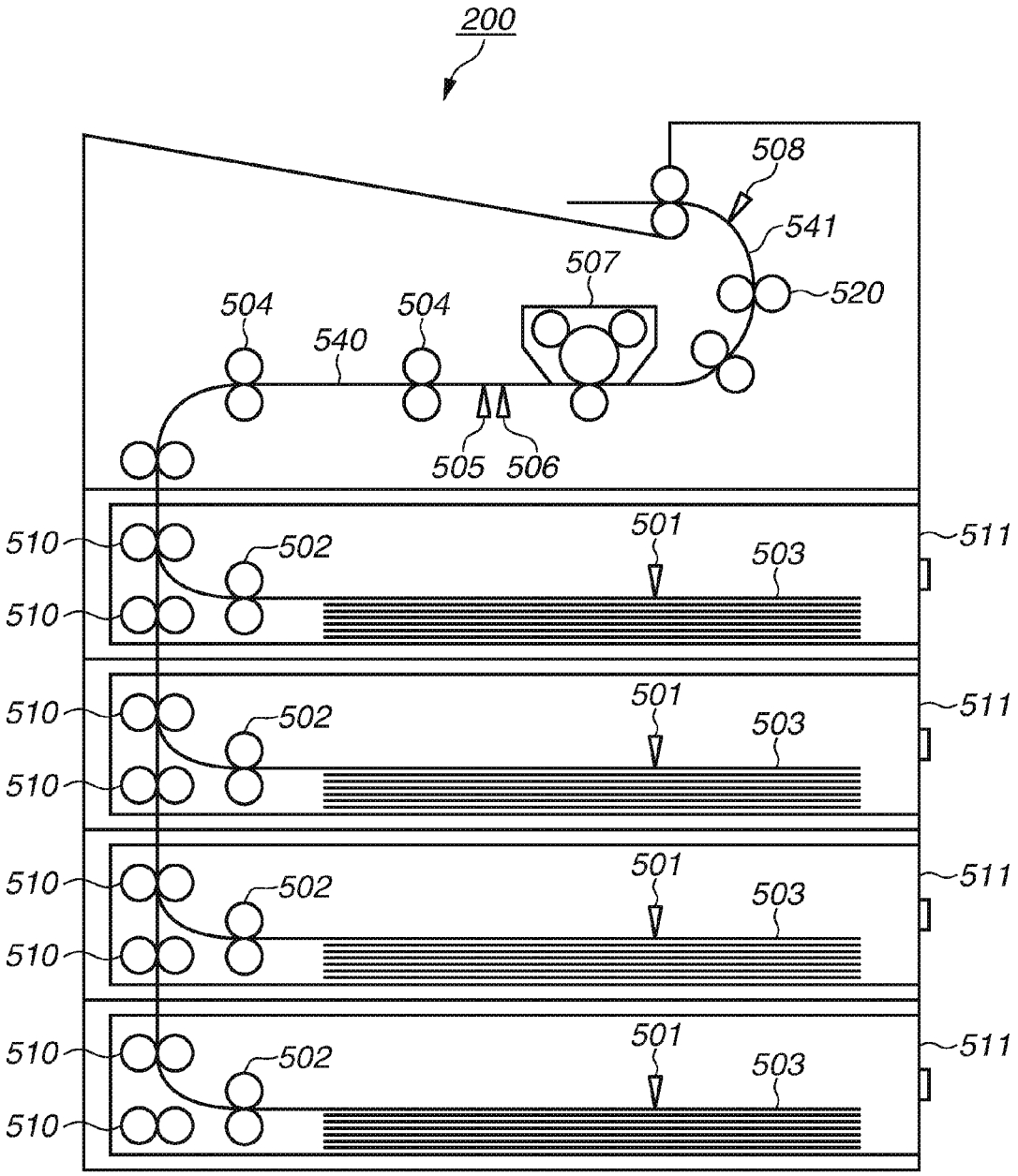
FIG. 1 is a cross-sectional view illustrating an internal configuration of a printer according to an exemplary embodiment.

First, an image forming apparatus according to the present exemplary embodiment will be described in detail below. The image forming apparatus includes a laser beam printer (Hereinbelow, referred to as "printer"). FIG. 1 illustrates an internal cross-sectional configuration of a printer 200. The printer 200 includes a plurality of paper feeder cassettes 511, an image forming unit 507, a main conveyance path 540, and a discharge conveyance path 541. The printer 200 further includes a plurality of rollers (e.g., feed rollers 502, conveyance rollers 510, registration rollers 504, and discharge rollers 520), which is provided along respective conveyance paths, to convey a sheet 503 (i.e., paper or recording material) on which an image is to be formed. The printer 200 further includes a plurality of sensors (e.g., paper feeding cassette paper presence sensors 501, a registration sensor 505, a paper detection sensor 506, and a discharge sensor 508), to detect the sheet 503 in the apparatus. Each paper feeder cassette 511 functions as a feed unit configured to supply the sheet 503 in the apparatus.

The image forming unit 507 is a consumable product that includes an exposure unit, a photosensitive drum, and a developing unit, which are incorporated in a replaceable casing that is attachable to and detachable from an apparatus main body, to form an image on the sheet 503. The consumable product is, for example, a toner cartridge 224 (described below), which includes an information holding unit and a residual quantity detection sensor that can detect the residual quantity of filled toner. The image forming unit 507 causes the exposure unit to form an electrostatic latent image on the photosensitive drum (i.e., an image bearing unit). The electrostatic latent image can be formed based on image data received by a controller 210 (described below) from an external device. The developing unit develops the electrostatic latent image formed by the image forming unit 507. More specifically, toner particles are attached to the electrostatic latent image and transferred to a sheet at a predetermined transfer position. The transferred image is referred to as a toner image. A fixing apparatus (not illustrated) can fix the toner image formed on the sheet by heating and pressing the sheet (i.e., paper or recording material).

The main conveyance path 540, along which an image can be formed on the sheet 503, extends from the feed rollers 502 to the discharge rollers 520. The conveyance rollers 510 constitute a part of the paper feeder cassette 511. Therefore, the paper conveyance path from a lower paper feeder cassette 511 is disconnected when an upper paper feeder cassette 511 is pulled out. The discharge conveyance path 541 is a conveyance path along which the sheet 503 can be discharged from the discharge rollers 520 to the outside of the printer 200. The feed rollers 502 can successively convey the sheets 503 stacked on the paper feeder cassette 511 to the inner side of the apparatus. The registration rollers 504 can adjust the timing at which the image forming unit 507 transfers an image to the conveyed sheet 503. The discharge rollers 520 discharge the sheet 503 to the outside of the printer 200.

The paper presence sensor 501 can detect the presence of the sheet 503 stacked on the paper feeder cassette 511. Each of the registration sensor 505, the paper detection sensor 506, and the discharge sensor 508 can detect the conveyed sheet. These sensors can be mechanical switches or optical sensors. The registration sensor 505 is used to adjust the timing at which the toner image formed on the photosensitive drum is transferred to the conveyed sheet 503. The registration sensor 505 is used as a sensor capable of measuring the length of the sheet 503 in a sub scanning direction. The length of the sheet 503 in the sub scanning direction is obtainable based on the time during which the registration sensor 505 keeps detecting the conveyed sheet 503 and the conveyance speed of the sheet 503. The paper detection sensor 506 is used to detect the presence of the sheet 503 at both end portions of the main conveyance path 540. The paper detection sensor 506 is usable as a sensor for obtaining the length of the sheet 503 in a main scanning direction.

<Control System>

Figure 2:
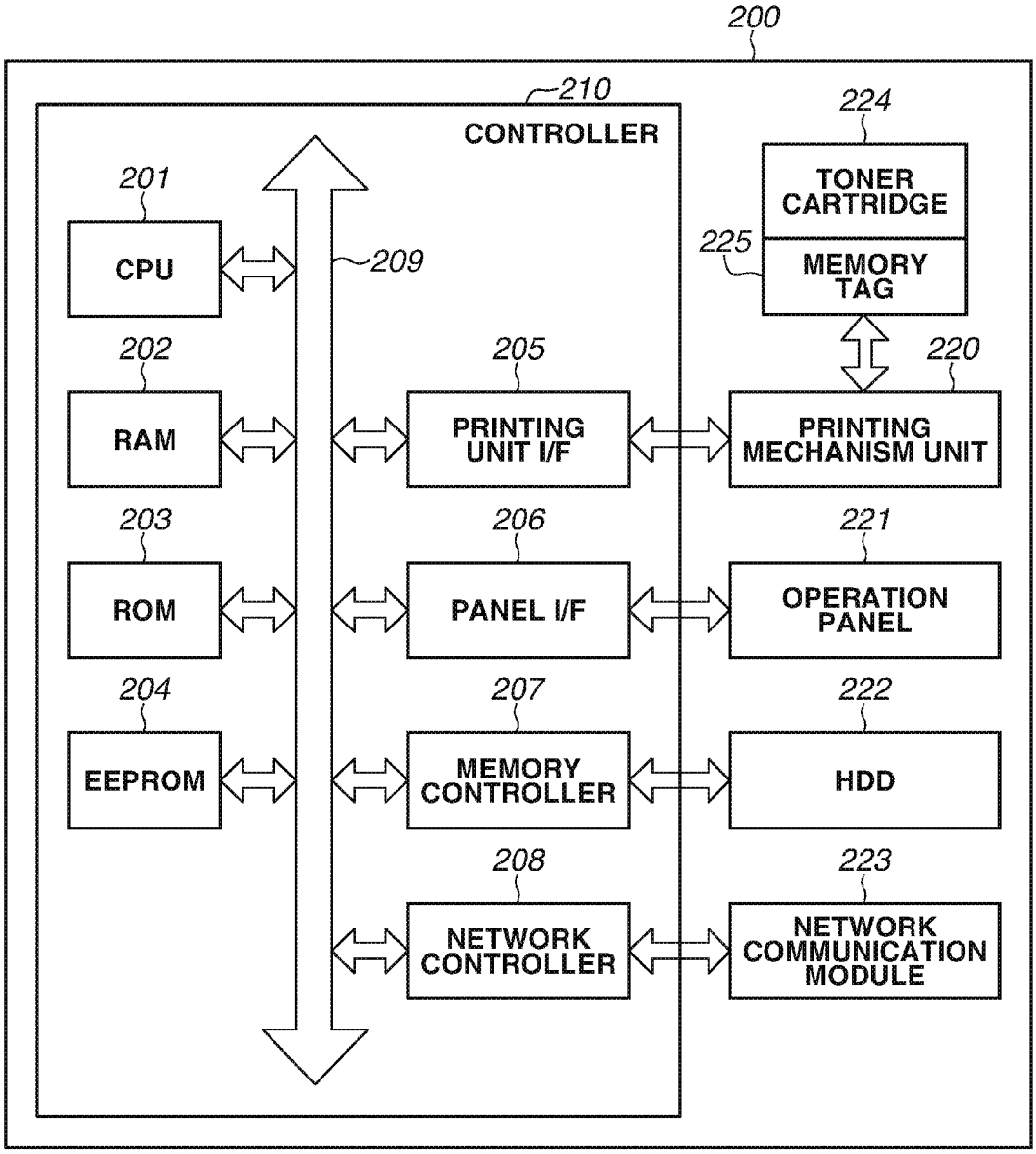
FIG. 2 is a block diagram illustrating a hardware configuration of a control system of the printer.

FIG. 2 is a block diagram illustrating an example configuration of a control system of the printer 200. The control system is constituted by the controller 210 and peripheral devices. The controller 210 is a computer including a central processing unit (CPU) 201, a random access memory (RAM) 202, a read only memory (ROM) 203, and an electrically erasable programmable read only memory (EEPROM) 204, which are connected to each other via a system bus 209. The controller 210 can function as a control unit. The CPU 201 can execute computer programs according to the present exemplary embodiment to access and control various devices connected to the system bus 209. The RAM 202 can function as a main memory and/or a work area of the CPU 201. The RAM 202 can expand its memory capacity if an optional RAM is connected to an extension port (not illustrated). The RAM 202 is usable as a drawing memory that can store image data received from an external device, or usable as a video signal ON/OFF information storage area or other work areas. The ROM 203 is a program ROM, which can store the above-mentioned control programs. The EEPROM 204 is a nonvolatile memory, which can store management information including individual information and replacement history unique to the toner cartridge 224 (described below). The EEPROM 204 can be replaced by any other nonvolatile memory, such as a Flash ROM or an embedded Multi Media Card (eMMC). In the following description, such a nonvolatile memory is referred to as "device built-in memory." A printing unit interface (I/F) 205, a panel I/F 206, a memory controller 207, and a network controller 208 are connected to the system bus 209.

The printing unit I/F 205 can transmit and receive print related information to and from a printing mechanism unit 220. The printing mechanism unit 220 corresponds to the printer 200 illustrated in FIG. 1. The panel I/F 206 can transmit and receive information to and from an operation panel 221. The memory controller 207 can control an access to a hard disk drive (HDD) 222. The network controller 208 can control a network communication module 223 to communicate with various information terminals via the network.

The printing mechanism unit 220 can access a memory tag 225 attached to the toner cartridge 224 that is filled with toner particles. In other words, the printing mechanism unit 220 can function as a reading unit configured to cause the controller 210 to read individual information from the memory tag 225. Further, the printing mechanism unit 220 can function as an update unit configured to update the individual information recorded in the memory tag 225 controlled by the controller 210. The operation panel 221 includes various operation switches and LED indicators. The CPU 201 can control the operation panel 221 via the panel I/F 206.

Figure 3:
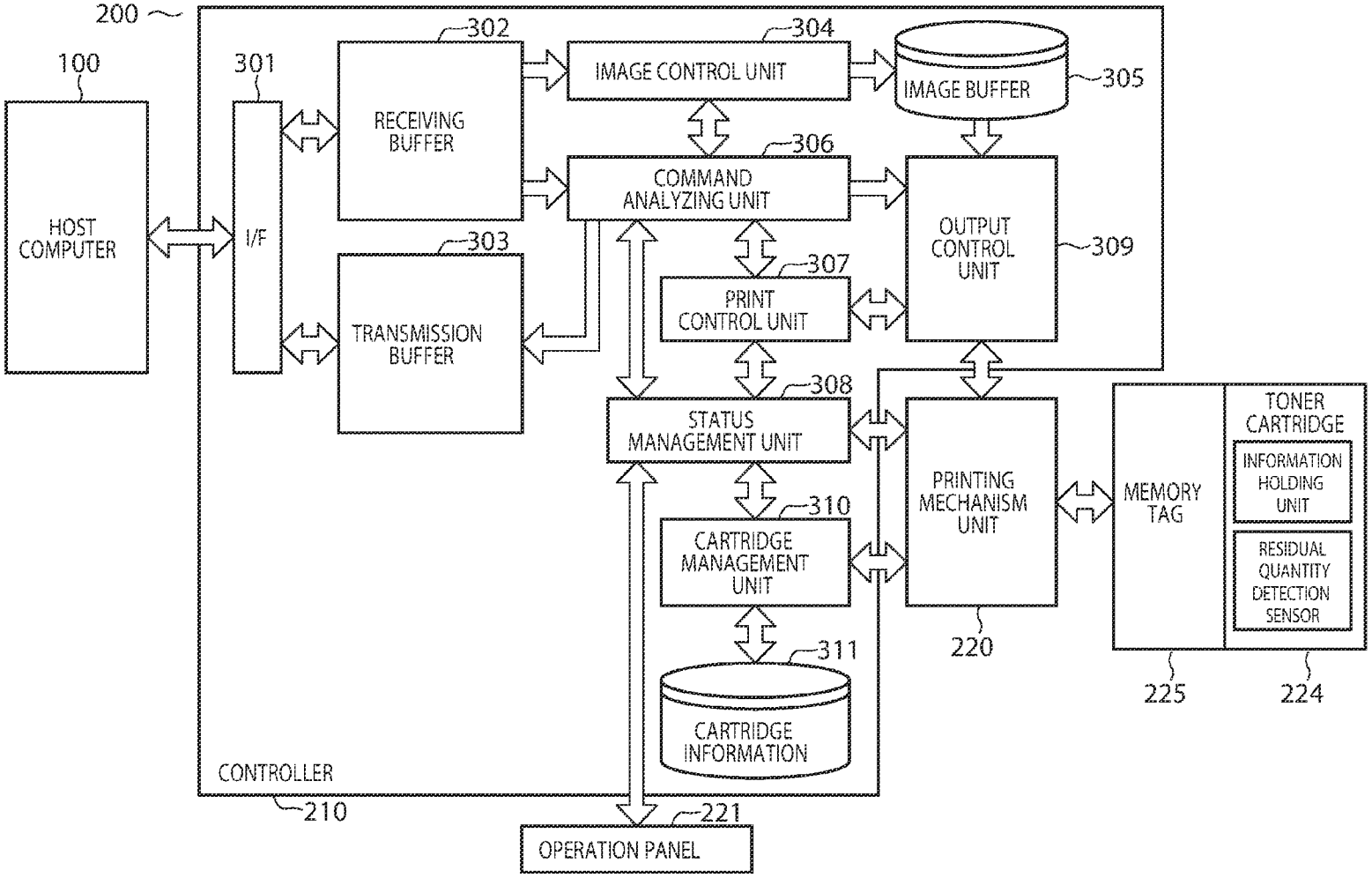
FIG. 3 is a block diagram illustrating a functional configuration of a controller.

FIG. 3 is a block diagram illustrating a functional configuration of the controller 210 that can be realized when the CPU 201 executes the control programs. The controller 210 includes an interface (I/F) 301. The I/F 301 is an interface connected to a host computer 100, which can function as a server or a client. The host computer 100 can output print information, which includes print data and control codes, to the controller 210. A receiving buffer 302 can successively store print information received via the I/F 301. Then, if necessary, a command analyzing unit 306 or an image control unit 304 can read the print information from the receiving buffer 302 and process the print information.

The command analyzing unit 306 can analyze commands included in the print information. The commands analyzed by the command analyzing unit 306 include commands relating to image data (e.g., bitmap data), which give instructions to the image control unit 304. On the other hand, commands not relating to drawing (e.g., feeding paper selection, reset command) give instructions to the print control unit 307. The image control unit 304 can perform predetermined image processing on image data transferred from the receiving buffer 302 with the instructions from the command analyzing unit 306. Further, the image control unit 304 can store processing results in an image buffer 305. A status management unit 308 can determine an operational state (status) of the printer 200 based on information from the print control unit 307. Further, the status management unit 308 can cause the operation panel 221 to display the state of the printer 200 and can return acquired status information in response to a status information acquisition command issued from the host computer 100. The status management unit 308 can transmit the status information to the host computer 100 via the command analyzing unit 306, a transmission buffer 303, and the I/F 301. An output control unit 309 can convert image data stored in the image buffer 305 into a video signal, and can transfer the video signal to the printing mechanism unit 220. The printing mechanism unit 220 is a printer engine that can form a permanently visual image based on the received video signal and can transfer the formed image to a sheet.

A cartridge management unit 310 can manage individual information unique to the toner cartridge 224 in corporation with the printing mechanism unit 220 and the memory tag 225. The individual information includes a serial number (i.e., identification information unique to the toner cartridge 224), reference date and time, operating results value, and device serial number. The individual information is not limited to the above-mentioned example and can be modified in such a way as to include at least one of the reference date and time and the use record value. The use record value is, for example, a printed page count value that changes according to the use record value, which does not decrease unless it is reset. In this respect, the use record value is greatly different from life information (life span) discussed in Japanese Patent Application Laid-Open No. 2008-250087. The reference date and time can used to manage the toner cartridge 224. For example, the reference date and time is time information about initial usage and time information about final usage (updated). The time information is information derived from a clocking function (i.e., one of standard functions) of the controller 210 (i.e., the CPU 201) and can be measured using a clock frequency of several seconds or less. The device serial number is identification information about an apparatus that has finally used the toner cartridge 224.

Figure 4:
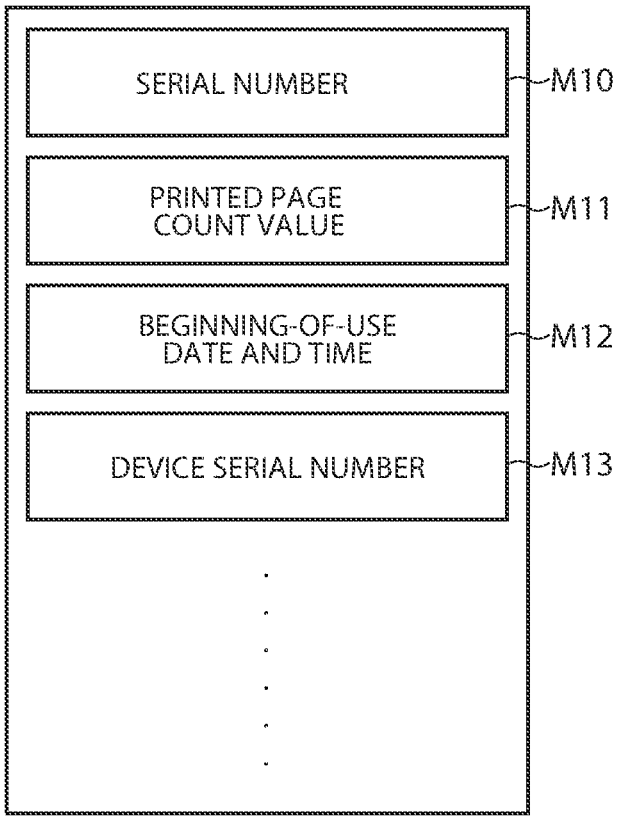
FIG. 4 is a block diagram illustrating a memory structure of a memory tag.

The toner cartridge 224 corresponds to the image forming unit 507 illustrated in FIG. 1, which includes the residual quantity detection sensor capable of detecting the residual quantity of toner particles and the information holding unit capable of holding individual information, which are disposed at predetermined portions. In the present exemplary embodiment, the information holding unit is the memory tag 225, which is a contactless IC memory. FIG. 4 illustrates a memory structure of the memory tag 225. The memory tag 225 stores a serial number M10 that is unique to the toner cartridge 224. Further, the memory tag 225 stores a printed page count value M11 that represents the use record value, a beginning-of-use date and time M12 (i.e., an example of the reference date and time), and a device serial number M13 that is identification information about a finally used apparatus (i.e., a currently using printer body). The cartridge management unit 310 generates cartridge information 311, as a single record, for each toner cartridge 224 and stores the generated information in the device built-in memory 204.

Figure 5:
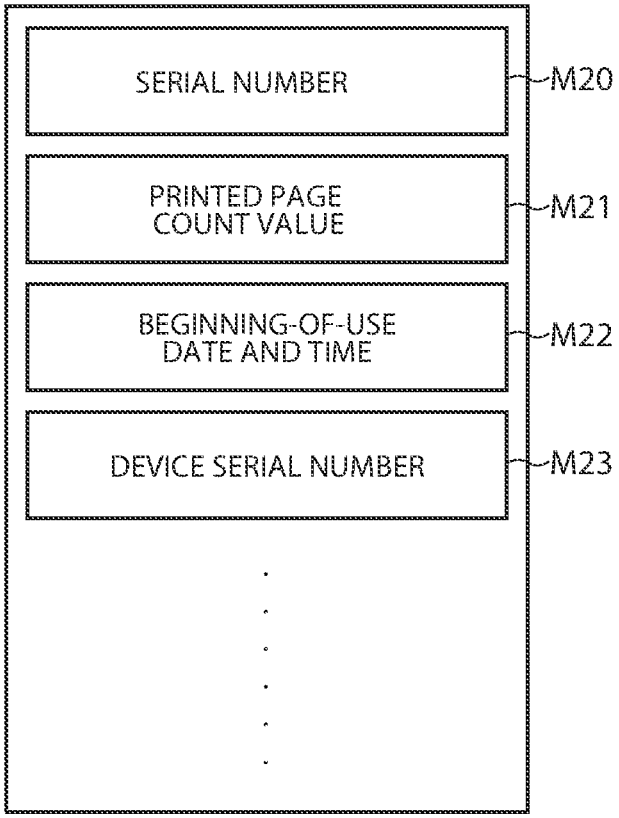
FIG. 5 is a block diagram illustrating an example of cartridge information recorded in a device built-in memory.

FIG. 5 is a block diagram illustrating an example of the cartridge information 311 recorded in the device built-in memory 204. The cartridge information 311 includes a serial number M20 of each toner cartridge, a printed page count value M21, a beginning-of-use date and time M22, and a device serial number M23, as a single record. Each record further includes cartridge size (e.g., normal or large capacity), finally used date and time (i.e., another example of the reference date and time), residual quantity, and cartridge type (e.g., reused). The printed page count value and the residual quantity include values measured at the beginning-of-use date and time and values measured at the latest use date and time.

The cartridge information 311 recorded in the nonvolatile memory can be browsed and printed at any time. For example, it is feasible to print and confirm the cartridge information 311 about the toner cartridge 224 having been presently and previously used in response to a print instruction received via the operation panel 221. FIG. 6 illustrates a printed example of the cartridge information 311. The cartridge information 311 can be displayed on a screen of the connected host computer 100.

The cartridge information 311 can be updated (or rewritten) at any time based on the information recorded in the memory tag 225. For example, the printed page count value M21 included in the cartridge information 311 recorded in the device built-in memory 204 can be rewritten into a changed value in synchronization with a change of the printed page count value M11 (i.e., use record value).

Figure 7:
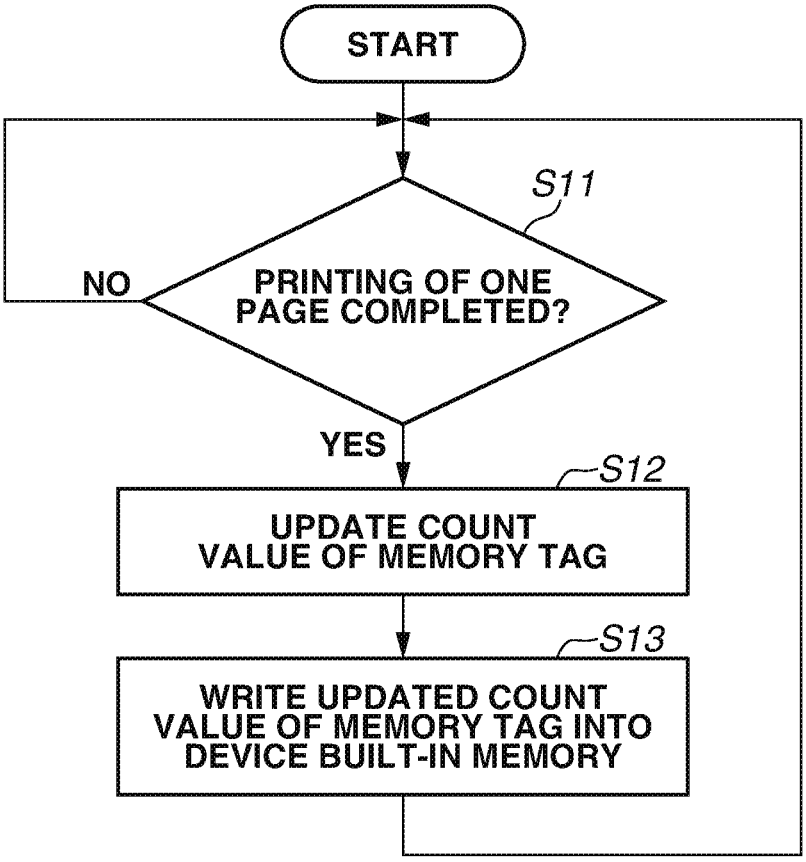
FIG. 7 is a flowchart illustrating a procedure of printed page counter update processing.

FIG. 7 is a flowchart illustrating a procedure of printed page counter update processing performed by the cartridge management unit 310. The cartridge management unit 310 waits until the printing of one page using the toner cartridge 224 completes (NO in step S11). If the printing completes (YES in step S11), then in step S12, the cartridge management unit 310 updates the printed page count value M11 of the memory tag 225. Subsequently, in step S13, the cartridge management unit 310 writes the updated printed page count value M11 of the memory tag 225 into the device built-in memory 204 as the printed page count value M22. According to the above-mentioned processing, respective printed page count values M11 and M21 are constantly the same unless the cartridge 224 is changed to another one. However, it is not always necessary to perform the printed page counter update processing for each page. For example, the cartridge management unit 310 performs the printed page count value update processing for every five pages, or for each print job.

The toner cartridge 224 has a replacement detection function as described in detail below. One of objects of the present exemplary embodiment is surely detecting an actual replacement of toner cartridge even in a case where the memory tag 225 of a replaced toner cartridge is a copied one and identical to that of a corresponding genuine toner cartridge. In this case, it is necessary to accurately manage the use record value and the replacement history regardless of the genuineness of the toner cartridge 224. However, in actual scenes, there is a case where the toner cartridge 224 is temporarily installed and used in another printer body and subsequently returned to the original printer body. Therefore, in the present exemplary embodiment, the image forming apparatus compares information recorded in the memory tag 225 with information stored in the device built-in memory 204 and, if a difference between two pieces of information (i.e., two pieces of individual information) exceeds a predetermined range, the image forming apparatus determines that the currently using toner cartridge 224 is a replaced one. Then, the image forming apparatus adds cartridge information read from the toner cartridge 224, as new cartridge information 311, to the device built-in memory 204.

Figure 8:
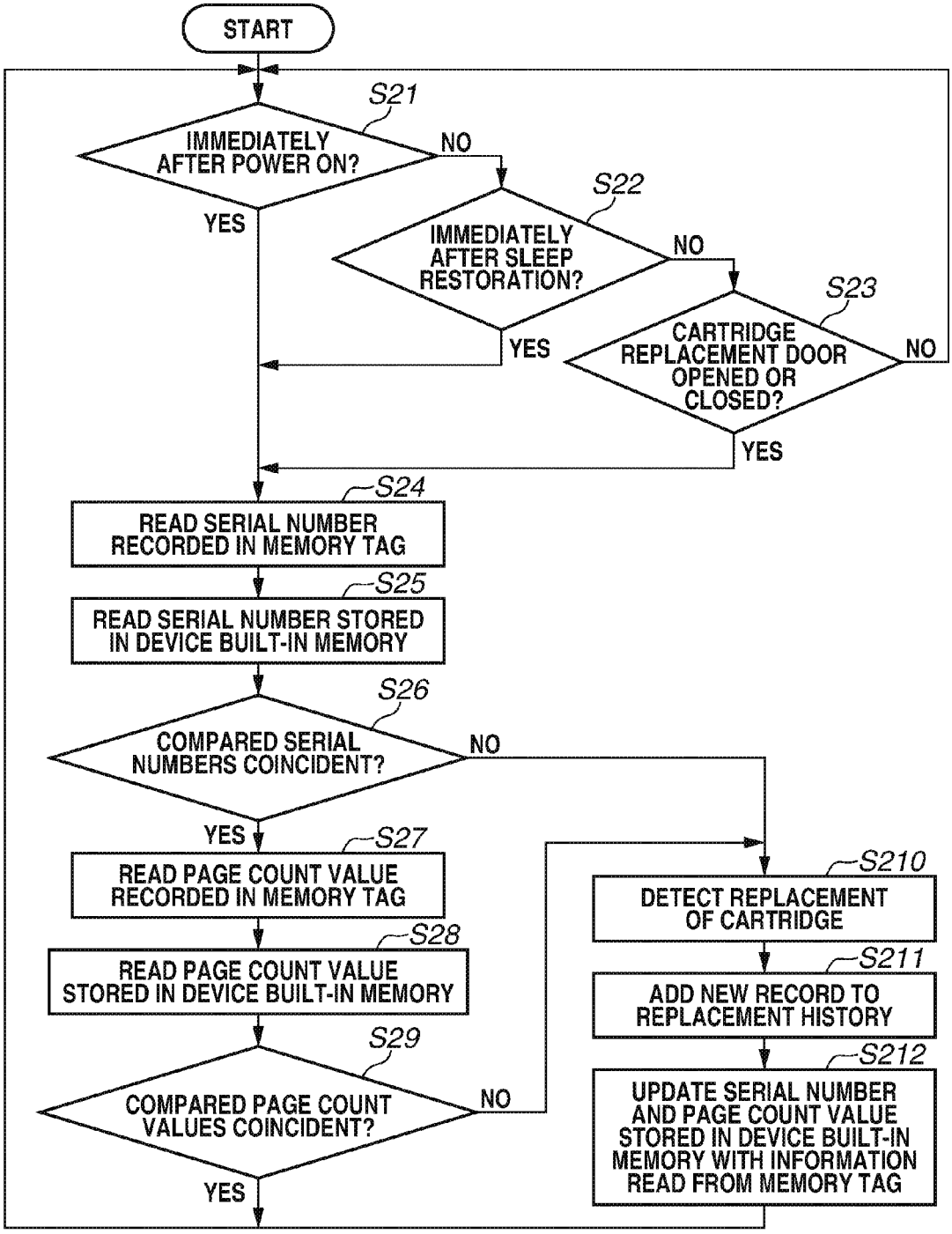
FIG. 8 is a flowchart illustrating a procedure of cartridge replacement detection processing according to a first exemplary embodiment.

The replacement detection function can be realized by the controller 210. FIG. 8 is a flowchart illustrating an example procedure of replacement detection processing that can be performed by the controller 210. In step S21, the controller 210 checks whether the present state is immediately after power supply ON of the printer 200. If the controller 210 determines that the present state is not immediately after power supply ON of the printer 200 (No in step S21), then in step S22, the controller 210 checks whether the present state is immediately after sleep restoration. If the controller 210 determines that the present state is not immediately after sleep restoration (NO in step S22), then in step 23, the controller 210 checks whether a cartridge replacement door has been opened or closed. If the controller 210 determines that the cartridge replacement door has been neither opened nor closed (NO in step S23), the operation returns to step S21. The above-mentioned processing in steps S21 to S23 means that the controller 210 is functionally operable as a detection unit configured to detect a state where there is a possibility that the toner cartridge 224 has been replaced. If the confirmation result in any one of steps S21, S22, and S23 is "YES" (YES in step S21, S22, or S23), the controller 210 determines that the printer 200 is currently in an operational state identified in step S21, S22, or S23. Then, the controller 210 compares the information recorded in the memory tag 225 with the information stored in the device built-in memory 204. Further, the controller 210 determines whether the difference between two pieces of information (i.e., two pieces of individual information) exceeds the predetermined range.

As an example, in step S24, the controller 210 reads the serial number M10 recorded in the memory tag 225 via the cartridge management unit 310. Further, in step S25, the controller 210 reads the serial number M20 stored in the device built-in memory 204. Then, in step S26, the controller 210 compares the read serial numbers M10 and M20. If the compared serial numbers coincide with each other (YES in step S26), then in step S27, the controller 210 reads the printed page count value M11 (i.e., the use record value) from the memory tag 225. Further, in step S28, the controller 210 reads the printed page count value M21 from the device built-in memory 204. Then, in step S29, the controller 210 compares the read printed page count values M11 and M21. If the compared printed page count values coincide with each other (YES in step S29), the controller 210 determines that the currently using toner cartridge 224 is not a replaced one because the difference is within the predetermined range, and then the operation returns to step S21.

If the serial numbers M10 and M20 do not coincide with each other (NO in step S26), or if the printed page count values M11 and M21 do not coincide with each other (NO in step S29), then in step S210, the controller 210 determines that the currently using toner cartridge 224 is a replaced one because the difference exceeds the predetermined range. In this case, in step S211, the controller 210 adds a new record to the cartridge information in the device built-in memory 204 and starts managing the replaced cartridge as a new cartridge (i.e., new individual information). Further, in step S212, the controller 210 overwrites and updates the serial number and the printed page count value stored in the device built-in memory 204 with the information read from the memory tag 225. Then, the operation returns to step S21.

As mentioned above, a significant amount of shift will occur in the printed page count value, if the toner cartridge 224 is temporarily installed and used in another printer body and subsequently returned to the original printer body. In this case, it may be erroneously determined that the toner cartridge has been replaced. Therefore, when the printed page count value recorded in the memory tag 225 is less than the printed page count value stored in the device built-in memory 204, the controller 210 can determine that the difference has exceeded the predetermined range.

As mentioned above, in the first exemplary embodiment, the image forming apparatus can detect a replacement of toner cartridge based on the comparison performed for checking the coincidence in printed page count value, more specifically, checking if the difference exceeds the predetermined range, even if the serial numbers of the compared cartridges are identical. More specifically, even in a case where a memory tag attached by a toner cartridge recycled product provider is a copy of a genuine memory tag of a brand-new cartridge (i.e., serial numbers are identical), the image forming apparatus can accurately detect the replaced cartridge and can accurately update the use record value and the replacement history. Further, if any possible cartridge replacement state (e.g., power supply ON, sleep restoration, or cartridge replacement door opening/closure) is detected, the image forming apparatus automatically launches the replacement detection function. Therefore, it is feasible to prevent the image forming apparatus from malfunctioning due to replacement of the toner cartridge 224.

Figure 9:
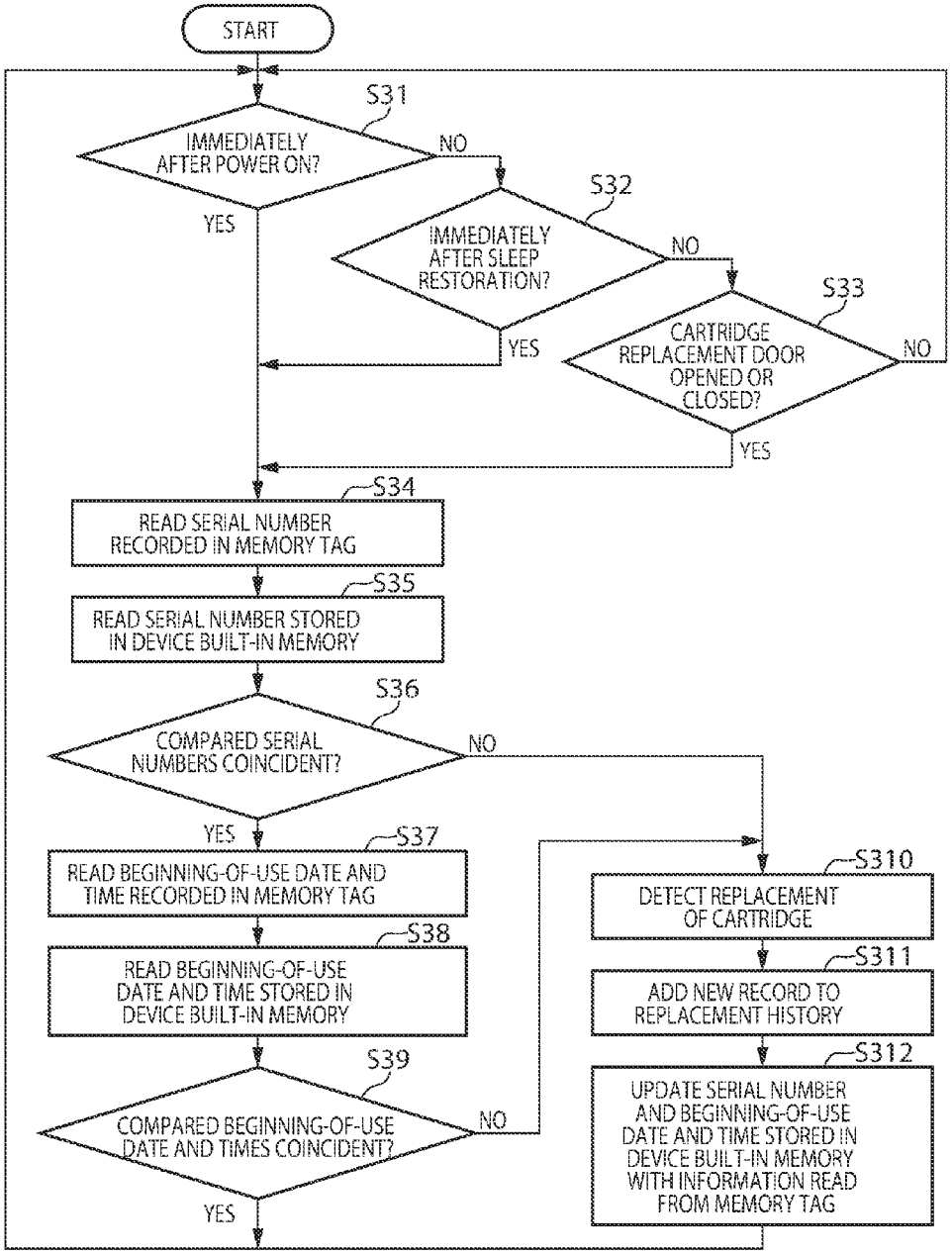
FIG. 9 is a flowchart illustrating a procedure of cartridge replacement detection processing according to a second exemplary embodiment.

Next, a second exemplary embodiment of the present invention will be described in detail below. In the second exemplary embodiment, the image forming apparatus compares two pieces of beginning-of-use date and time obtained from different toner cartridges. The image forming apparatus according to the present exemplary embodiment has a hardware configuration and a functional configuration similar to those described in the first exemplary embodiment. The image forming apparatus according to the present exemplary embodiment is different from the image forming apparatus described in the first exemplary embodiment in the contents of replacement detection processing to be performed by the cartridge management unit 310. FIG. 9 is a flowchart illustrating an example procedure of the replacement detection processing according to the present exemplary embodiment. Processing to be performed in steps S31 to S36 is similar to the processing performed in steps S21 to S26 illustrated in FIG. 8 and therefore redundant description thereof will be avoided.

If it is determined that the serial number read from the memory tag 225 coincides with the serial number read from the device built-in memory 204 (YES in step S36), then in step S37, the cartridge management unit 310 reads the beginning-of-use date and time from the memory tag 225. Further, in step S38, the cartridge management unit 310 reads the beginning-of-use date and time from the device built-in memory 204. Then, in step S39, the cartridge management unit 310 compares the two pieces of beginning-of-use date and time having been read. If it is determined that the two pieces of beginning-of-use date and time coincide with each other (YES in step S39), the cartridge management unit 310 determines that the toner cartridge 224 has not been replaced (remains the same), and the operation returns to step S31. If it is determined that the two pieces of beginning-of-use date and time do not coincide with each other (NO in step S39), then in step S310, the cartridge management unit 310 determines that the toner cartridge 224 is a replaced one because the difference exceeds the predetermined range. In this case, similar to the first exemplary embodiment, in step S311, the cartridge management unit 310 adds a new record to the cartridge information in the device built-in memory 204 and starts managing the replaced cartridge as a new cartridge history. Further, in step S312, the cartridge management unit 310 overwrites and updates the serial number and the beginning-of-use date and time stored in the device built-in memory 204 with the information read from the memory tag 225. Then, the operation returns to step S31.

As mentioned above, in the second exemplary embodiment, the image forming apparatus can detect a replacement of toner cartridge based on the comparison performed for checking the coincidence in beginning-of-use date and time even if the serial numbers of the compared cartridges are identical.

Figure 10:
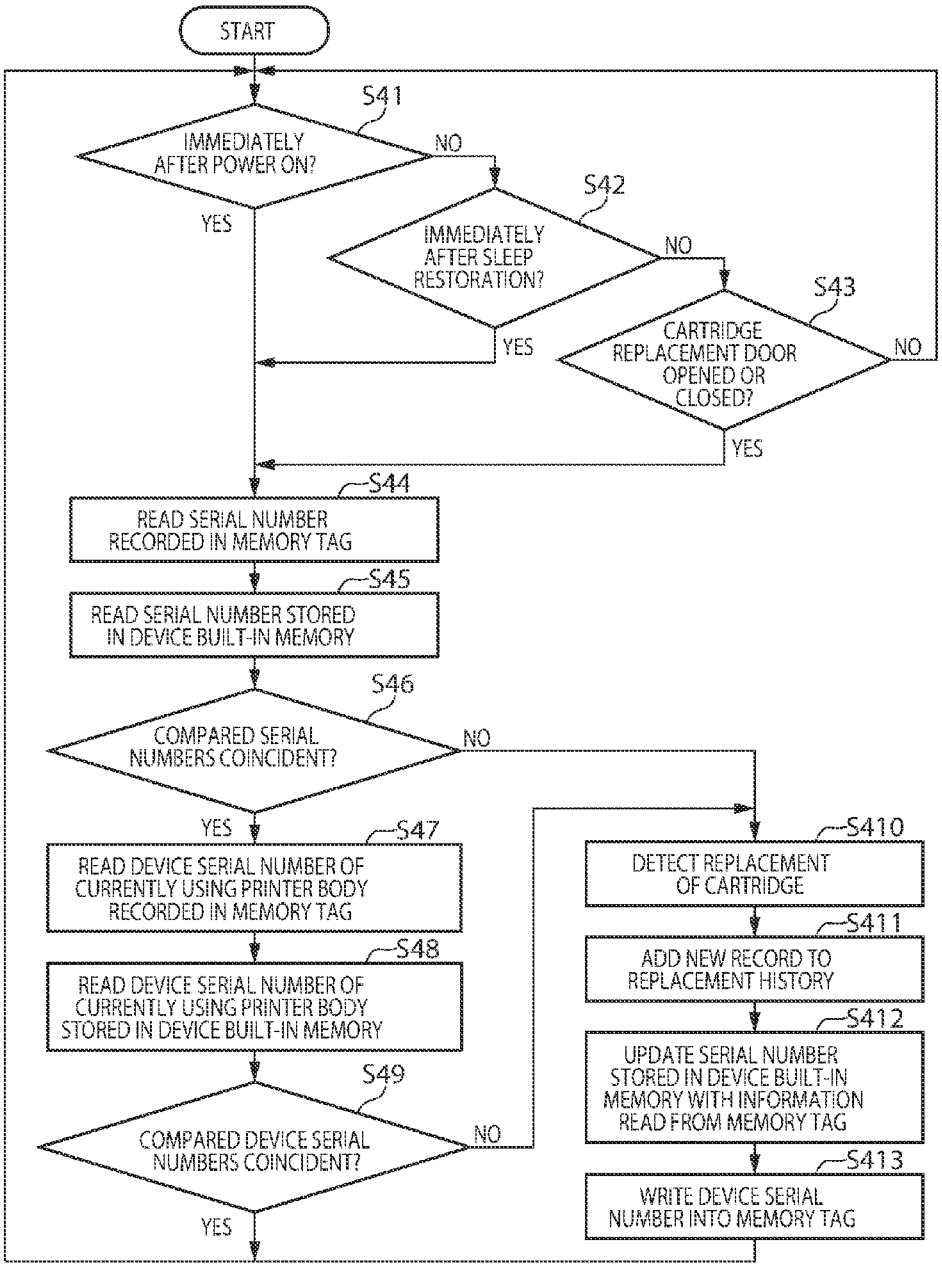
FIG. 10 is a flowchart illustrating a procedure of cartridge replacement detection processing according to a third exemplary embodiment.

Next, a third exemplary embodiment of the present invention will be described in detail below. In the third exemplary embodiment, the image forming apparatus compares device serial numbers of currently using apparatuses. The image forming apparatus according to the present exemplary embodiment has a hardware configuration and a functional configuration similar to those described in the first exemplary embodiment. The image forming apparatus according to the third exemplary embodiment is different from the image forming apparatus described in the first exemplary embodiment in the contents of replacement detection processing to be performed by the cartridge management unit 310. FIG. 10 is a flowchart illustrating an example procedure of the replacement detection processing according to the present exemplary embodiment. Processing to be performed in steps S41 to S46 is similar to the processing performed in steps S21 to S26 illustrated in FIG. 8. Therefore, redundant description thereof will be avoided.

If the serial number read from the memory tag 225 coincides with the serial number read from the device built-in memory 204 (YES in step S46), then in step S47, the cartridge management unit 310 reads the device serial number of the currently using printer body from the memory tag 225. Further, in step S48, the cartridge management unit 310 reads the device serial number of the printer body from the device built-in memory 204. Then, in step S49, the cartridge management unit 310 compares the read device serial numbers. If the compared device serial numbers coincide with each other (YES in step S49), the cartridge management unit 310 determines that the toner cartridge 224 has not been replaced (remains the same). Then, the operation returns to step S41. If the compared device serial numbers do not coincide with each other (NO in step S49), then in step S410, the cartridge management unit 310 determines that the toner cartridge is a replaced one because the difference exceeds the predetermined range. In this case, in step S411, similar to the first exemplary embodiment, the cartridge management unit 310 adds a new record to the cartridge information in the device built-in memory 204 and starts managing the replaced cartridge as a new cartridge history. Further, in step S412, the cartridge management unit 310 overwrites and updates the serial number stored in the device built-in memory 204 with the information read from the memory tag 225. Then, in step S413, the cartridge management unit 310 rewrites the device serial number in the memory tag 225. Then, the operation returns to step S41.

As mentioned above, in the third exemplary embodiment, the image forming apparatus can detect a replacement of toner cartridge based on the comparison performed for checking the coincidence in device serial number of the printer body even if the serial numbers of the compared cartridges are identical.

Next, a fourth exemplary embodiment of the present invention will be described in detail below. In the fourth exemplary embodiment, the image forming apparatus compares two pieces of life alarm history information. The life alarm history information is warning history information (irreversible information) about residual life span of the cartridge to be recorded in the cartridge when the toner cartridge residual quantity observed by the printing mechanism unit 220 becomes less than a predetermined value. The life alarm history information can be set beforehand via a setting unit (not illustrated). The life alarm history information is, for example, "FULL state" indicating that the residual quantity is very great, "LOW state" indicating that the residual quantity is very small, or "OUT state" indicating that the residual quantity is zero. Each brand-new cartridge is in the "FULL state." The state changes from the "FULL state" to the "LOW state" and then to "OUT state" successively with increasing consumed toner amount. The life alarm history information is irreversible information discriminable from history information that can be obtained through simple residual quantity detection, in that the state does not change when the cartridge is refilled with toner particles.

Figure 11:
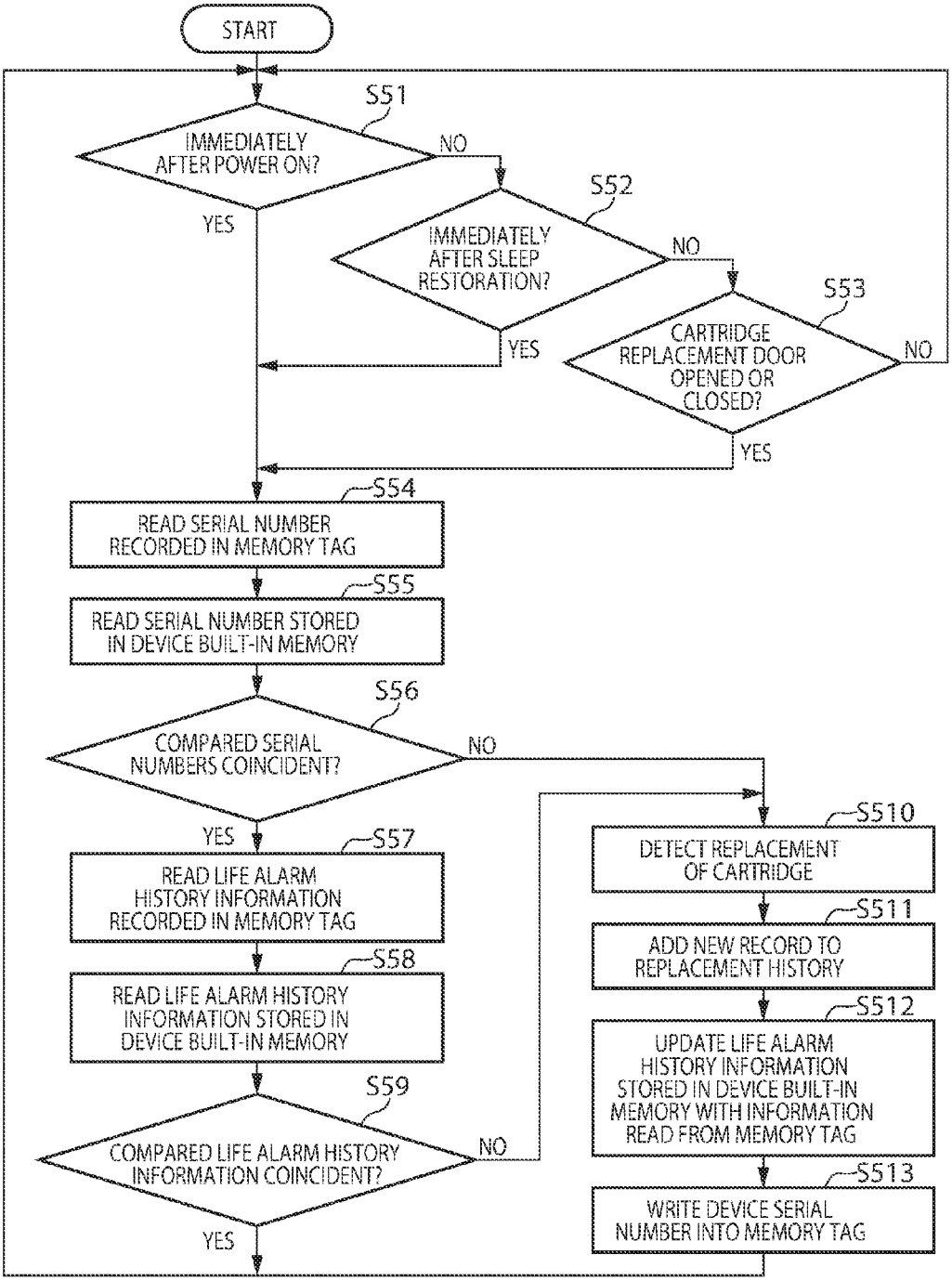
FIG. 11 is a flowchart illustrating a procedure of cartridge replacement detection processing according to a fourth exemplary embodiment.

The image forming apparatus according to the present exemplary embodiment has a hardware configuration and a functional configuration similar to those described in the first exemplary embodiment. The image forming apparatus according to the present exemplary embodiment is different from the image forming apparatus described in the first exemplary embodiment in the above-mentioned setting unit (not illustrated) and in the replacement detection processing to be performed by the cartridge management unit 310. FIG. 11 is a flowchart illustrating a procedure of replacement detection processing according to the present exemplary embodiment. Processing in steps S51 to S56 is similar to the processing performed in steps S21 to S26 illustrated in FIG. 8. Therefore, redundant description thereof will be avoided.

If it is determined that the serial number read from the memory tag 225 coincides with the serial number read from the device built-in memory 204 (YES in step S56), then in step S57, the cartridge management unit 310 reads the life alarm history information from the memory tag 225. Further, in step S58, the cartridge management unit 310 reads the life alarm history information from the device built-in memory 204. Then, in step S59, the cartridge management unit 310 compares the two pieces of life alarm history information. If the two pieces of life alarm history information coincide with each other (YES in step S59), the cartridge management unit 310 determines that the toner cartridge 224 has not been replaced (remains the same). Then, the operation returns to step S51. If the two pieces of life alarm history information do not coincide with each other (NO in step S59), then in step S510, the cartridge management unit 310 determines that the toner cartridge is a replaced one because the difference exceeds the predetermined range. Then, in step S511, similar to the first exemplary embodiment, the cartridge management unit 310 adds a new record to the cartridge information in the device built-in memory 204 and starts managing the replaced cartridge as a new cartridge history. Further, in step S512, the cartridge management unit 310 overwrites and updates the life alarm history information stored in the device built-in memory 204 with the information read from the memory tag 225. In step S513, the cartridge management unit 310 rewrites the device serial number in the memory tag 225. Then, the operation returns to step S51.

The determination in step S59, i.e., the processing for determining coincidence in the life alarm history information, is not limited to a case where coincidence is strictly required in details. For example, it is feasible to set an appropriate margin in the coincidence determination considering an error in the residual toner quantity detection to be referred to in cartridge life determination, as described in detail below with reference to FIG. 12. When the above-mentioned residual quantity detection sensor is used to observe the residual toner quantity, it is uncertain whether the residual toner quantity of the cartridge is observed as being in the "FULL state" or observed as being in the "LOW state" if the detected value is on a borderline. Similarly, it is uncertain whether the residual toner quantity of the cartridge is observed as being in the "LOW state" or observed as being in the "OUT state" if the detected value is on another borderline. The above-mentioned uncertainty is dependent on the performance of the residual quantity detection sensor or the flow of consumed toner particles outgoing from the toner cartridge. In general, it is very difficult to eliminate such an observation error completely.

Therefore, it is useful to set an appropriate margin in the coincidence determination when the fact that the life alarm history information never returns to the "FULL state" once it changes into the "LOW state" or the "OUT state" is taken into consideration, regardless of any change in the residual toner quantity. More specifically, in a case where the life alarm history information stored in the main body built-in memory 204 is "FULL state" and the life alarm history information read from the memory tag 225 is "LOW state" or "OUT state", it can be determined that the cartridge remains the same. Further, in a case where the life alarm history information stored in the main body built-in memory 204 is "LOW state" and the life alarm history information read from the memory tag 225 is "OUT state", it can be determined that the cartridge remains the same.

On the other hand, there is a case where the toner warning information read from the memory tag 225 is determined as "FULL state" even though the life alarm history information stored in the main body built-in memory 204 is "LOW state." Such a phenomenon never occurs if the cartridge remains the same. Therefore, it can be determined that the currently using cartridge is a replaced one. Similarly, in a case where the toner warning information read from the memory tag 225 is determined as "FULL state" or "LOW state" even though the life alarm history information stored in the main body built-in memory 204 is "OUT state", it can be determined that the currently using cartridge is a replaced one.

As mentioned above, according to the fourth exemplary embodiment, the image forming apparatus can identify a replacement of toner cartridge based on the comparison performed for checking the coincidence in life alarm history information even if the serial numbers of the compared cartridges are identical.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181586, filed Sep. 15, 2015, which is hereby incorporated by reference herein in its entirety.

What is claimed is:

1. An image forming apparatus that can form an image by using a toner cartridge filled with toner particles, the toner cartridge having a first non-volatile memory, the first nonvolatile memory holding individual information including at least one of reference date and time and use record value, wherein the image forming apparatus includes a second non-volatile memory configured to store the individual information, at least one processor and at least one memory coupled to the at least one processor, and the at least one processor and the at least one memory act as:

a reading unit configured to read the individual information from the first non-volatile memory of the toner cartridge;

a control unit configured to perform a first control or a second control, in which the first control includes adding the individual information read from the first non-volatile memory of the toner cartridge, as new individual information, to the second non-volatile memory of the image forming apparatus based on a comparison between the reference date and time included in the individual information held in the first non-volatile memory of the toner cartridge and reference date and time included in individual information stored in the second non-volatile memory of the image forming apparatus, and the second control includes adding the individual information read from the first non-volatile memory of the toner cartridge, as new individual information, to the second non-volatile memory of the image forming apparatus based on a comparison between the use record value included in the individual information held in the memory of the toner cartridge and use record value included in the individual information stored in the second non-volatile memory of the image forming apparatus;

a detection unit configured to detect a residual toner quantity of the toner cartridge using a sensor; and a setting unit configured to set irreversible life alarm history information into the first non-volatile memory of the toner cartridge, based on the residual toner quantity detected by the detection unit, wherein the first non-volatile memory of the toner cartridge has at least an area for storing the individual information about the toner cartridge and an area for storing the irreversible life alarm history information.

2. The image forming apparatus according to claim 1, wherein the individual information includes the use record value, and the control unit rewrites the individual information held in the first non-volatile memory of the toner cartridge and the individual information stored in the second non-volatile memory of the image forming apparatus into a changed use record value in response to a change of the use record value.

3. The image forming apparatus according to claim 1, wherein if the use record value held in the first non-volatile memory of the toner cartridge is smaller than the use record value stored in the second non-volatile memory of the image forming apparatus, the control unit rewrites the use record value of the new individual information by the use record value held in the first non-volatile memory of the toner cartridge.

4. The image forming apparatus according to claim 1, wherein the individual information includes the reference date and time, and if the reference date and time included in the individual information held in the first non-volatile memory of the toner cartridge does not coincide with the reference date and time included in the individual information stored in the second non-volatile memory of the image forming apparatus, the control unit rewrites the reference date and time of the new individual information by the reference date and time of the toner cartridge.

5. The image forming apparatus according to claim 4, wherein the reference date and time is time information indicating initial usage start of the toner cartridge.

6. The image forming apparatus according to claim 1, wherein the individual information includes identification information about the toner cartridge and apparatus identification information about an apparatus that has finally used the toner cartridge, and wherein if the apparatus identification information held in the first non-volatile memory of the toner cartridge does not coincide with the apparatus identification information stored in the second non-volatile memory of the image forming apparatus, the control unit rewrites the apparatus identification information included in the individual information held in the first non-volatile memory of the toner cartridge by the apparatus identification information about the image forming apparatus.

7. The image forming apparatus according to claim 1, wherein the at least one processor and the at least one memory further act as:

a detection unit configured to detect a state where there is a possibility that the toner cartridge has been replaced, wherein the control unit performs the first control or the second control in response to a detection of the state by the detection unit.

8. The image forming apparatus according to claim 1, wherein the sensor is provided at a predetermined portion of the toner cartridge.

9. The image forming apparatus according to claim 1, wherein the control unit performs the first control or the second control, upon condition that the toner cartridge has been replaced.

10. The image forming apparatus according to claim 9, wherein the at least one processor and the at least one memory further act as:

an output unit configured to output history information of the toner cartridge based on the individual information about the toner cartridge stored in the second non-volatile memory, wherein the control unit adds specific information indicating that the toner cartridge is of a specific type as the new individual information about the toner cartridge when adding the new individual information by the first control or the second control.

11. The image forming apparatus according to claim 10, wherein the output unit outputs toner cartridge information based on the individual information including the specific information and the toner cartridge information based on the individual information not including the specific information so as to be distinguishable.

12. A consumable product management method for an image forming apparatus that can form an image by using a toner cartridge filled with toner particles, the toner cartridge having a first non-volatile memory that holds individual information including at least one of reference date and time and use record value, and the image forming apparatus includes a second non-volatile memory configured to store the individual information, the method comprising:

reading individual information from the first non-volatile a memory of the toner cartridge performing a first control or a second control, in which the first control includes adding the individual information read from the first non-volatile memory of the toner cartridge, as new individual information, to the second non-volatile memory of the image forming apparatus based on a comparison between the reference date and time included in the individual information held in the first non-volatile memory of the toner cartridge and reference date and time included in individual information stored in the second non-volatile memory of the image forming apparatus, and the second control includes adding the individual information read from the first non-volatile memory of the toner cartridge, as new individual information, to the second non-volatile memory of the image forming apparatus based on a comparison between the use record value included in the individual information held in the first non-volatile memory of the toner cartridge and use record value included in individual information stored in the second non-volatile memory of the image forming apparatus;

detecting a residual toner quantity of the toner cartridge using a sensor; and setting irreversible life alarm history information into the first non-volatile memory of the toner cartridge, based on the detected residual toner quantity, wherein the first non-volatile memory of the toner cartridge has at least an area for storing the individual information about the toner cartridge and an area for storing the irreversible life alarm history information.

13. A non-transitory computer readable storage media storing a instructions that, when executed by one or more processors, cause an image forming apparatus that can form an image by using a toner cartridge filled with toner particles, the toner cartridge having a first non-volatile memory that holds individual information including at least one of reference date and time and use record value, and the image forming apparatus including a second non-volatile memory configured to store the individual information, to perform a consumable product management method, the method comprising:

reading individual information from the first non-volatile memory of the toner cartridge performing a first control or a second control, in which the first control includes adding the individual information read from the first non-volatile memory of the toner cartridge, as new individual information, to the second non-volatile memory of the image forming apparatus based on a comparison between the reference date and time included in the individual information held in the first non-volatile memory of the toner cartridge and reference date and time included in individual information stored in the second non-volatile memory of the image forming apparatus, and the second control includes adding the individual information read from the first non-volatile memory of the toner cartridge, as new individual information, to the second non-volatile memory of the image forming apparatus based on a comparison between the use record value included in the individual information held in the first non-volatile memory of the toner cartridge and use record value included in individual information stored in the second non-volatile memory of the image forming apparatus;

detecting a residual toner quantity of the toner cartridge using a sensor; and setting irreversible life alarm history information into the first non-volatile memory of the toner cartridge, based on the detected residual toner quantity, wherein the first non-volatile memory of the toner cartridge has at least an area for storing the individual information about the toner cartridge and an area for storing the irreversible life alarm history information.

* * * * *